US007356276B2

(12) United States Patent
Eom

(10) Patent No.: US 7,356,276 B2
(45) Date of Patent: Apr. 8, 2008

(54) HIGH VOLTAGE GENERATOR AND METHOD OF SENSING ROLLER RESISTANCE

(75) Inventor: Yoon-Seop Eom, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 310 days.

(21) Appl. No.: 11/282,763

(22) Filed: Nov. 21, 2005

(65) Prior Publication Data

US 2006/0147222 A1 Jul. 6, 2006

(30) Foreign Application Priority Data

Jan. 5, 2005 (KR) ..... 10-2005-0000826

(51) Int. Cl.
*G03G 15/00* (2006.01)

(52) U.S. Cl. ..... 399/88; 399/38; 399/48; 399/50; 399/53; 399/66; 399/67

(58) Field of Classification Search ..... 399/38, 399/48, 50, 53, 66, 67, 88
See application file for complete search history.

(56) References Cited

U.S. PATENT DOCUMENTS

| | | | | |
|---|---|---|---|---|
| 6,070,025 | A * | 5/2000 | Jeong | 399/66 |
| 6,477,339 | B1 * | 11/2002 | Yano et al. | 399/66 |
| 7,035,563 | B2 * | 4/2006 | Sawada | 399/66 |
| 7,068,956 | B2 * | 6/2006 | Tsukida et al. | 399/27 |

FOREIGN PATENT DOCUMENTS

| | | |
|---|---|---|
| JP | 05-313522 | 11/1993 |
| JP | 09-073242 | 3/1997 |
| JP | 09-096977 | 4/1997 |
| JP | 10-186945 | 7/1998 |
| JP | 10-207257 | 8/1998 |
| JP | 2001-109206 | 4/2001 |
| JP | 2001-112160 | 4/2001 |
| JP | 2001-154506 | 6/2001 |
| JP | 2002-108068 | 4/2002 |
| JP | 2003-262993 | 9/2003 |

* cited by examiner

*Primary Examiner*—Hoan Tran
(74) *Attorney, Agent, or Firm*—Roylance, Abrams, Berdo & Goodman L.L.P.

(57) ABSTRACT

Provided are a high voltage generator of an image forming apparatus, which simplifies a circuit structure and reduces the number of control signals by commonly using a roller resistance sensing circuit unit, and a method of sensing roller resistance. The high voltage generator applies high voltages to a plurality of rollers included in the image forming apparatus and senses resistance values of the rollers. The high voltage generator includes a plurality of voltage-pumping circuit units for providing high voltages to the respective rollers. A plurality of high voltage divide circuit units divide the high voltages output from the voltage-pumping circuit units. A multiplexer receives a plurality of divide signals output from the high voltage divide circuit units, selects and outputs a divide signal, which corresponds to a resistance of a roller to be sensed, based on a predetermined select signal. A roller resistance sensing circuit unit resets the selected divide signal output from the multiplexer to meet an input voltage range of an analog-digital converter, output the reset signal, and is commonly used to sense the resistance values of the rollers.

12 Claims, 8 Drawing Sheets

| S0 | S1 | S2 | OUT |
|---|---|---|---|
| 0 | 0 | 0 | CHARGING |
| 1 | 0 | 0 | DEVELOPING |
| 0 | 1 | 0 | TRANSFERRING Y |
| 1 | 1 | 0 | TRANSFERRING M |
| 0 | 0 | 1 | TRANSFERRING C |
| 1 | 0 | 1 | TRANSFERRING K |
| 0 | 1 | 1 | PAPER-ABSORBING |
| 1 | 1 | 1 | |

HIGH VOLTAGE GENERATOR AND METHOD OF SENSING ROLLER RESISTANCE

BACKGROUND OF THE INVENTION

This application claims the benefit under 35 U.S.C. §119 (a) of Korean Patent Application No. 10-2005-0000826, filed on Jan. 5, 2005, in the Korean Intellectual Property Office, the entire disclosure of which is hereby incorporated by reference.

FIELD OF THE INVENTION

The present invention relates to an image forming apparatus. More particularly, the present invention relates to a high voltage generator of an image forming apparatus, which simplifies a circuit structure and reduces the number of control signals by commonly using a roller resistance sensing circuit unit, and a method of sensing roller resistance.

DESCRIPTION OF THE RELATED ART

A high voltage-generating board of a color image forming apparatus outputs a plurality of high voltages. The high voltages are applied to rollers such as a developing roller, a charging roller, and a transferring roller for printing operations. A resistance value of a roller changes according to environmental factors and the lifespan of the roller. For top quality printing, it is necessary to sense a resistance value of a roller to which a high voltage is applied because different amounts of electric current flow through the roller in accordance with a change in the resistance value of the roller, even though the same voltage is applied to the roller.

FIG. 1 is a conventional image forming apparatus 100 including a high voltage generator 200. Referring to FIG. 1, the image forming apparatus 100 includes an image processing controller 110, an analog-digital converter (ADC) 120, a multiplexer 130, an analog sensor 140, and the high voltage generator 200.

The high voltage generator 200 includes a charging roller high voltage generator 201, a developing roller high voltage generator 202, a toner-supplying roller high voltage generator 203, a transferring roller high voltage generator 204, and a paper-absorbing roller high voltage generator 205.

The high voltage generator 200 outputs a high voltage to a plurality of rollers, such as a charging roller 261, a developing roller 262, a toner-supplying roller 263, a transferring roller 264, and a paper-absorbing roller 265.

The high voltage generator 200 outputs control signals to the multiplexer 130 in order to sense the resistance of each of the charging roller 261, the developing roller 262, the toner-supplying roller 263, the transferring roller 264, and the paper-absorbing roller 265. For example, the high voltage generator 200 may output one control signal for the charging roller 261, four control signals for the transferring roller 264, and one control signal for the paper-absorbing roller 265 to the multiplexer 130.

The multiplexer 130 also receives analog signals from the analog sensor 140 and outputs an analog signal to the ADC 120. The ADC 120 converts the analog signal to a digital signal and outputs the digital signal to the image processing controller 110.

The image processing controller 110 calculates a resistance value of each of the charging roller 261, the developing roller 262, the toner-supplying roller 263, the transferring roller 264, and the paper-absorbing roller 265 using the digital signal output from the ADC 120 and outputs a high voltage control signal as a pulse width modulation signal to the high voltage generator 200 based on the calculated resistance value.

FIG. 2 is a graph showing a duty percent and a voltage level of the high voltage control PWM signal. FIG. 3A is a graph showing sensed characteristics of electric current flowing through the charging roller 261. FIG. 3B is a graph showing sensed characteristics of electric current flowing through the transferring roller 264. FIG. 4 is a block diagram of the high voltage generator 200 illustrated in FIG. 1.

Referring to FIG. 4, the high voltage generator 200 includes a chopping circuit unit 210, a high voltage transformer 220, a voltage-pumping circuit unit 230, a high voltage divide circuit unit 240, and a roller resistance sensing circuit unit 250.

A PWM signal is transmitted as a high voltage control signal to the high voltage generator 200, which then generates a high voltage for driving a roller 260. Referring to FIG. 2, as the duty percent of a transferring voltage PWM signal increases, the level of the output transferring voltage becomes higher.

The chopping circuit unit 210 chops the PWM signal for high voltage control, which is output from the image processing controller 110, and transmits the chopped PWM signal to the high voltage transformer 220. The high voltage transformer 220 transforms the chopped PWM signal output from the high voltage transformer 220 into a high voltage and transmits the high voltage to the voltage pumping circuit unit 230. The voltage-pumping circuit unit 230 pumps the high voltage output from a second coil of the high voltage transformer 220 and transmits the high voltage to the roller 260.

The voltage-pumping circuit unit 230 also transmits the high voltage to the high voltage divide circuit unit 240, and the high voltage divide circuit unit 240 divides the high voltage output from the voltage-pumping circuit unit 230 and outputs the divided high voltage to the roller resistance sensing circuit unit 250.

FIG. 3A is a graph showing sensed characteristics of electric current flowing through the charging roller 261. Since a negative voltage is applied to the charging roller 261 as a charging voltage, a sensed voltage is proportional to a value of electric current flowing through the resistance of the charging roller 261.

FIG. 3B is a graph showing sensed characteristics of electric current flowing through the transferring roller 264. Since a positive voltage is applied to the transferring roller 264 as a transferring voltage, a sensed voltage is inversely proportional to a value of electric current flowing through the resistance of the transferring roller 264.

As described above, a plurality of voltage-pumping circuit units 230 are required to apply high voltages to the charging roller 261, the developing roller 262, the toner-supplying roller 263, the transferring roller 264, and the paper-absorbing roller 265, respectively.

In addition, a plurality of high voltage divide circuit units 240 and a plurality of roller resistance sensing circuit units 250 are required to sense the resistance of each of the charging roller 261, the developing roller 262, the toner-supplying roller 263, the transferring roller 264, and the paper-absorbing roller 265. For example, typically between three and ten high voltage divide circuit units 240 and roller resistance sensing circuit units 250 are generally required to sense one charging roller 261, four transferring rollers 264, one paper-absorbing roller 265, and four developing rollers 262.

An optimal developing condition can be maintained if the resistance of all rollers is sensed. However, if the roller resistance sensing circuit unit 250 is included in the high voltage generator 200, manufacturing costs of the image forming apparatus 100 are increased. In other words, since voltages are conventionally sensed and output by between three and six roller resistance sensing circuit units 250, a lot of sensing circuits are required.

U.S. Pat. No. 6,173,131, the entire disclosure of which is hereby incorporated by reference discloses an image forming apparatus that measures a resistance value based on a temperature of a heat roller, divides a power voltage according to the measured resistance value, and outputs the divided power voltage to a multiplexer. However, determining the resistance of rollers via a temperature measurement is not as accurate as directly measuring the resistance. Therefore, there is a need for an apparatus for directly measuring resistance without the increased cost and complexity of multiple roler resistance sensing circuit units.

SUMMARY OF THE INVENTION

Embodiments of the present invention provide a high voltage generator of an image forming apparatus, which simplifies a circuit structure and reduces the number of control signals by commonly using a roller resistance sensing circuit unit.

Embodiments of the present invention also provide a method of sensing roller resistance in which a high voltage generator of an image forming apparatus simplifies a circuit structure and reduces the number of control signals by commonly using a roller resistance sensing circuit unit.

According to an aspect of the present invention, there is provided a high voltage generator for applying high voltages to a plurality of rollers included in an image forming apparatus and sensing resistance values of the rollers. The high voltage generator includes a plurality of voltage-pumping circuit units for outputting the high voltages to the rollers. A plurality of high voltage divide circuit units divide the high voltages output from the voltage-pumping circuit units. A multiplexer receives a plurality of divide signals output from the high voltage divide circuit units, and selects and outputs a divide signal, which corresponds to a resistance of a roller to be sensed, based on a predetermined select signal. A roller resistance sensing circuit unit resets the selected divide signal output from the multiplexer to meet an input voltage range of an analog-to-digital converter, outputs the reset signal, and is commonly used to sense the resistance values of the rollers.

According to another aspect of the present invention, there is provided a method of applying high voltages to a plurality of rollers included in an image forming apparatus and sensing resistance values of the rollers using a high voltage generator. The method includes dividing the high voltages respectively output from a plurality of voltage-pumping circuit units using a plurality of high voltage divide circuit units respectively corresponding to the voltage-pumping circuit units. A plurality of divide signals output from the high voltage divide circuit units are received by a multiplexer and selecting and outputting A divide signal corresponding to a resistance of a roller to be sensed is selected based on a predetermined select signal. The selected divide signal output from the multiplexer is reset to meet an input voltage range of an analog-to-digital converter and output using a roller resistance sensing circuit unit.

When embodiments of the present invention are used, a roller resistance sensing circuit unit is commonly used in a high voltage generator of an image forming apparatus. As a result, a circuit can be simplified, manufacturing costs can be decreased, and the size of a printed circuit board of a high voltage generating board can be reduced.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numbers will be understood to refer to like elements, features, and structures.

DETAILED DESCRIPTION OF EXEMPLARY EMBODIMENTS

Exemplary embodiments of the present invention will now be described more fully with reference to the accompanying drawings. It should be understood, however, that the invention may be embodied in many different forms and should not be construed as being limited to the exemplary embodiments set forth therein. Rather, descriptions of exemplary embodiments are provided so that this disclosure will be thorough and complete, and will fully convey the concept of the invention to those skilled in the art.

Figure 1:
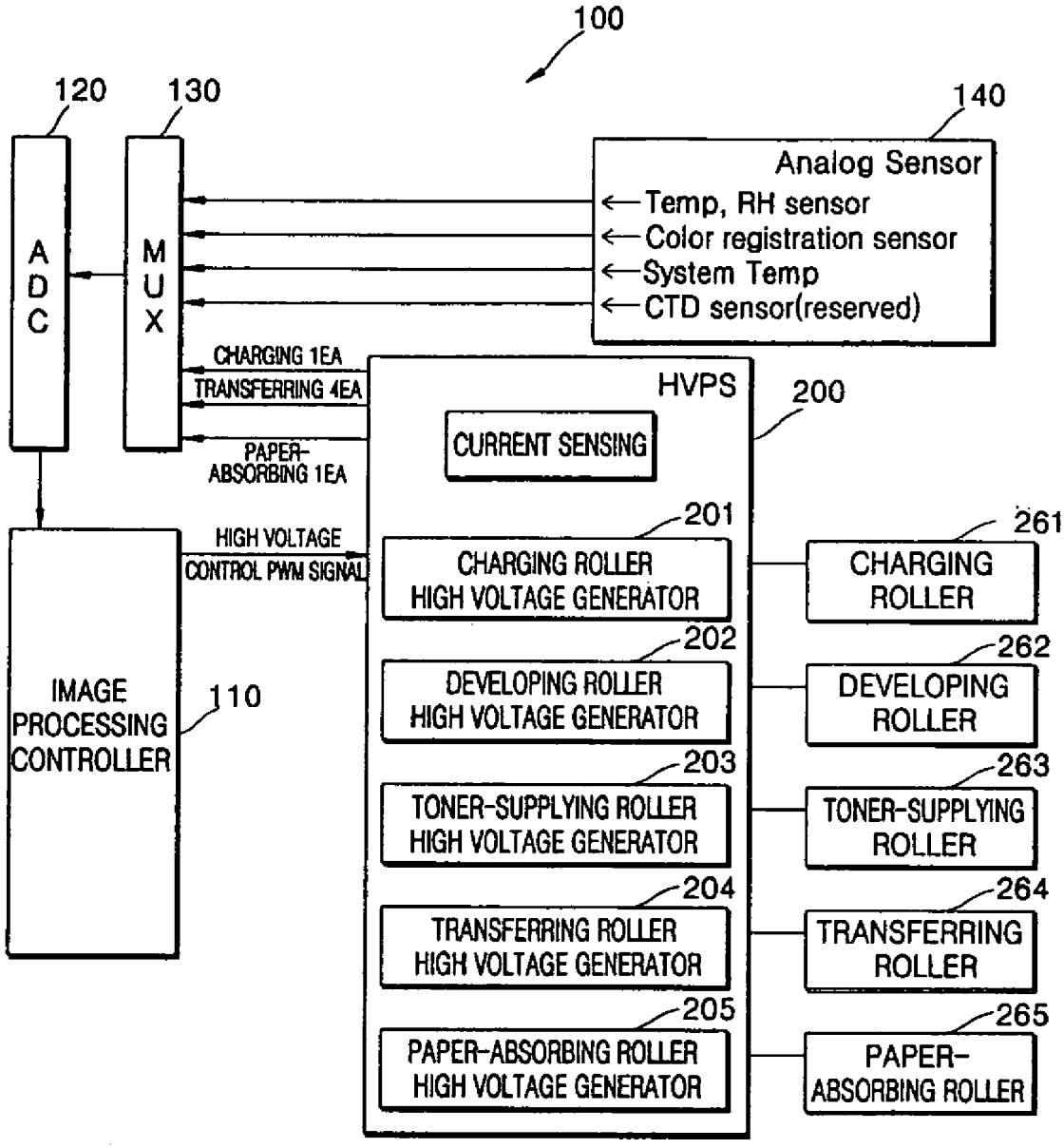
FIG. 1 (PRIOR ART)
FIG. 1 is a conventional image forming apparatus including a high voltage generator.
Figure 2:
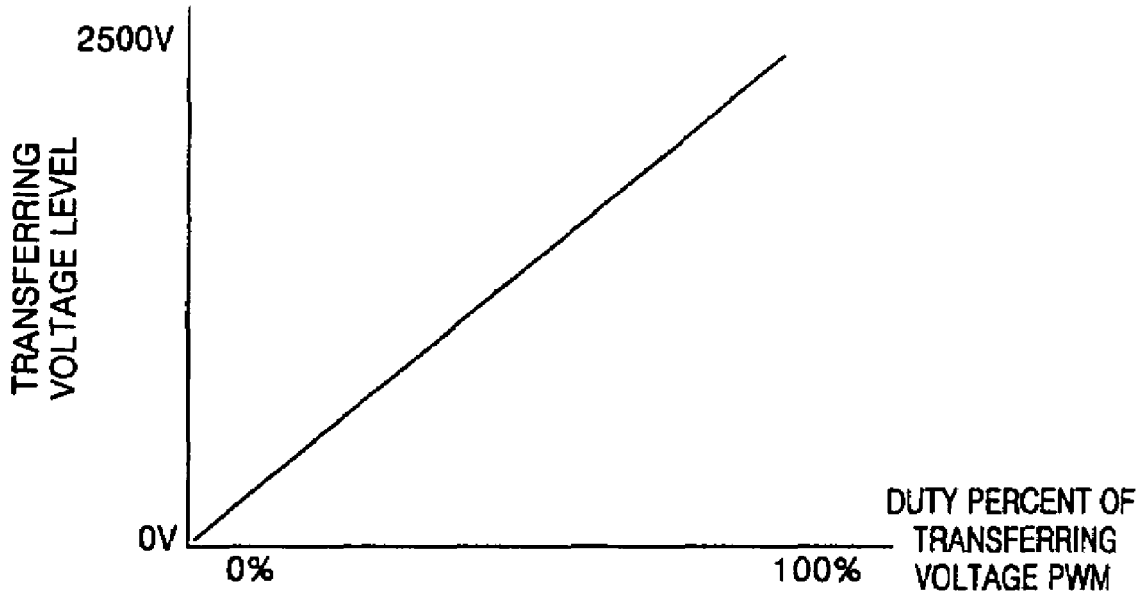
FIG. 2 (PRIOR ART)
FIG. 2 is a graph showing a duty percentage and a voltage level of a high voltage control pulse width modulation (PWM) signal.
Figure 3A:
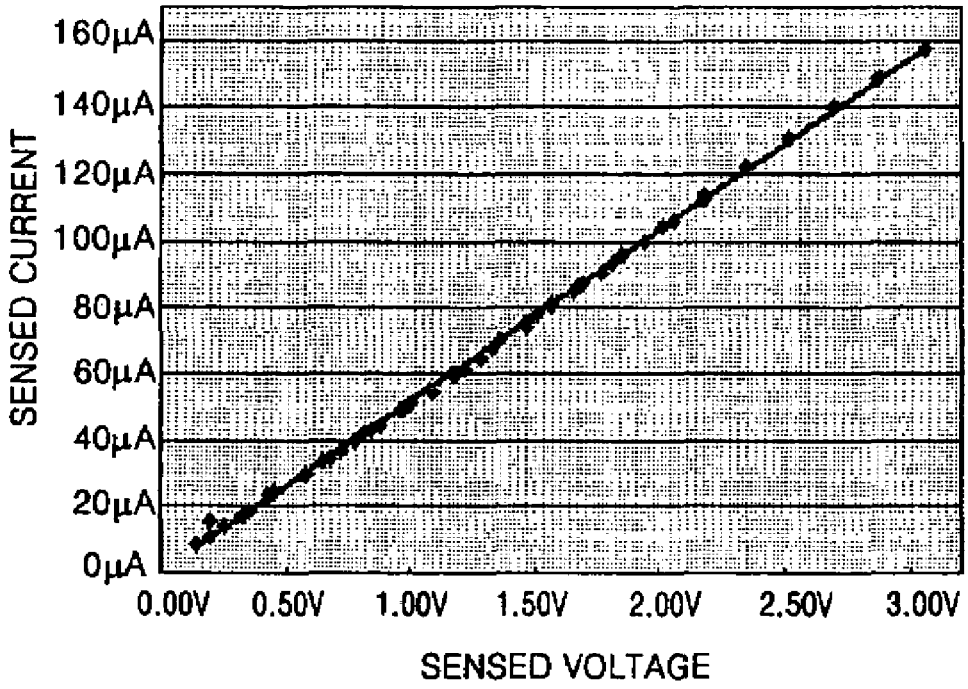
FIG. 3A (PRIOR ART)
FIG. 3A is a graph showing sensed characteristics of electric current flowing through a charging roller.
Figure 3B:
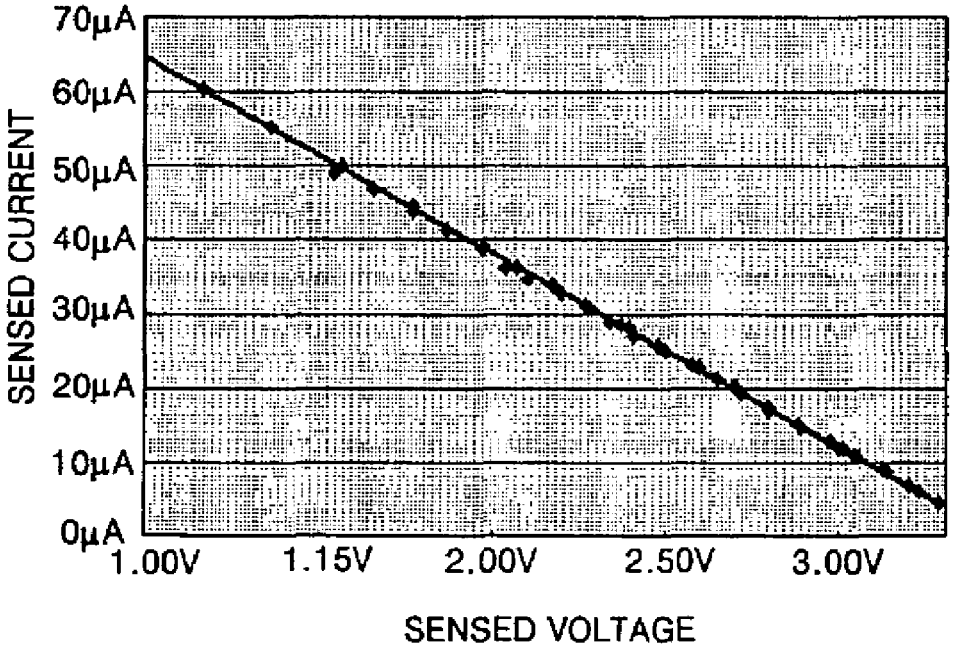
FIG. 3B (PRIOR ART)
FIG. 3B is a graph showing sensed characteristics of electric current flowing through a transferring roller.
Figure 4:
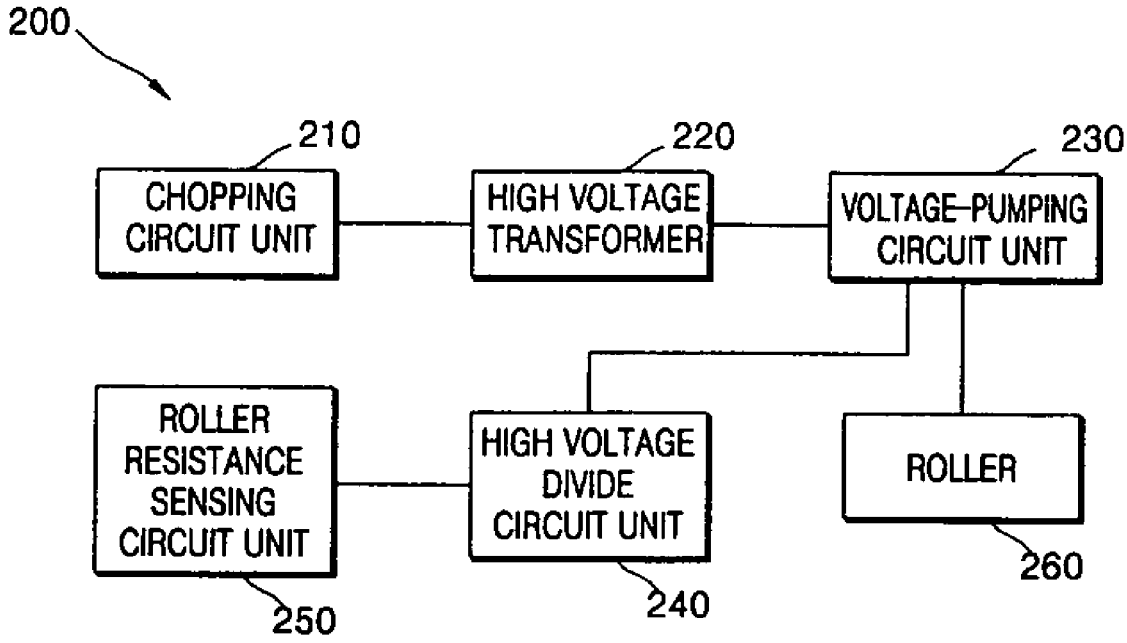
FIG. 4 (PRIOR ART)
FIG. 4 is a block diagram of the high voltage generator illustrated in FIG. 1.
Figure 5:
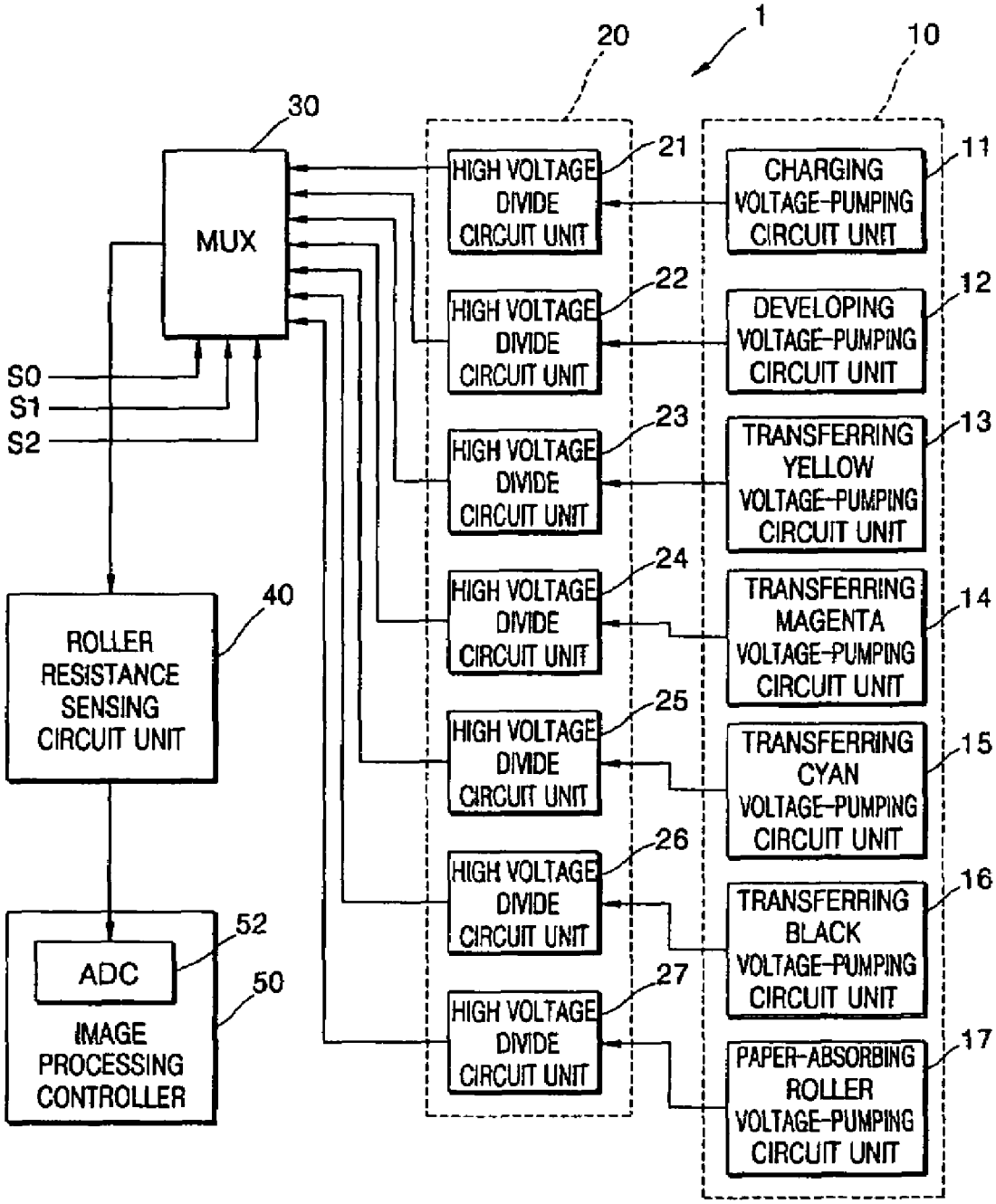
FIG. 5 is a block diagram of a high voltage generator according to an embodiment of the present invention.
Figures 6, 7:
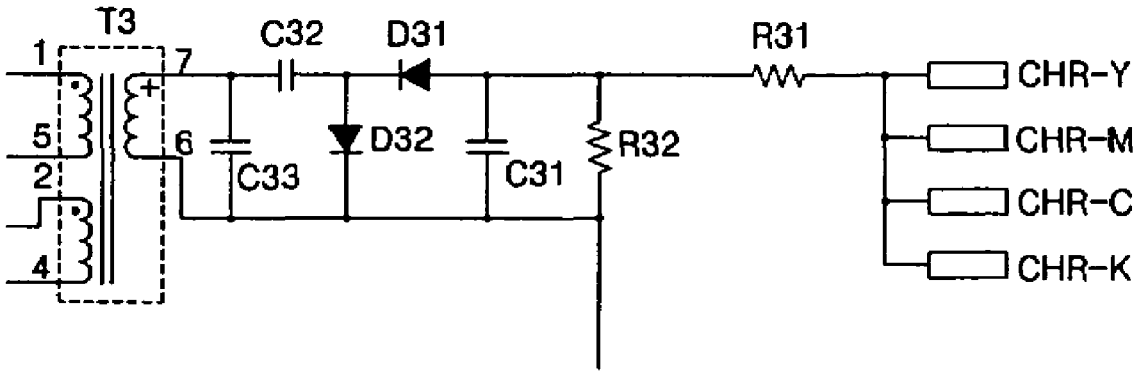
FIG. 6 illustrates a select signal input to a multiplexer according to an embodiment of the present invention.
FIG. 7 is a circuit diagram of a charging voltage-pumping circuit unit according to an embodiment of the present invention.

FIG. 5 is a block diagram of a high voltage generator 1 according to an embodiment of the present invention. FIG. 6 illustrates a select signal input to a multiplexer 30.

Referring to FIG. 5, the high voltage generator 1 includes a voltage-pumping circuit unit 10, a high voltage divide circuit unit 20, a multiplexer 30, a roller resistance sensing circuit unit 40, an image processing controller 50, and a analog-to-digital converter (ADC) 52.

The voltage-pumping circuit unit 10 includes at least a charging voltage pumping circuit unit 11, a developing voltage-pumping circuit unit 12, a transferring yellow voltage-pumping circuit unit 13, a transferring magenta voltage-pumping circuit unit 14, a transferring cyan voltage-pumping circuit unit 15, a transferring black voltage-pumping circuit unit 16, and a paper-absorbing roller voltage-pumping circuit unit 17.

Each of the charging voltage pumping circuit unit 11, the developing voltage-pumping circuit unit 12, the transferring yellow voltage-pumping circuit unit 13, the transferring magenta voltage-pumping circuit unit 14, the transferring cyan voltage-pumping circuit unit 15, the transferring black voltage-pumping circuit unit 16, and the paper-absorbing roller voltage-pumping circuit unit 17 supplies high voltage to a corresponding roller. For example, the charging voltage-pumping circuit unit 11 supplies high voltage to a charging roller.

Figure 8:
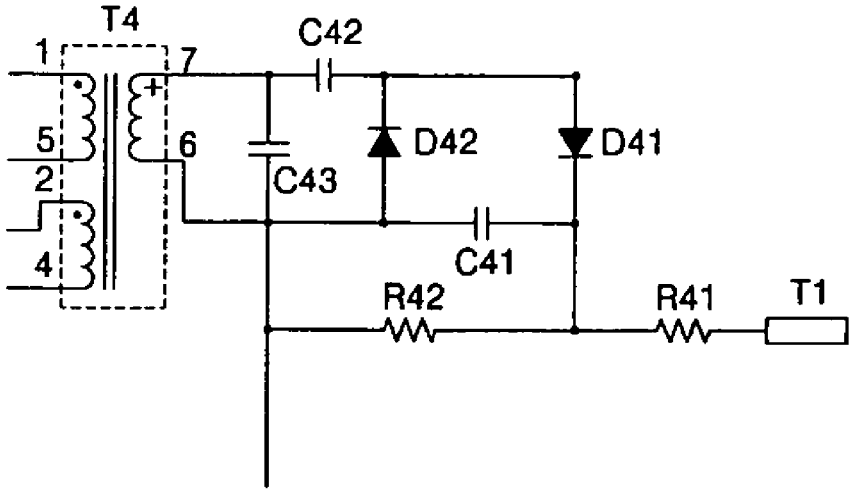
FIG. 8 is a circuit diagram of a transferring voltage-pumping circuit unit according to an embodiment of the present invention.

FIG. 7 is a circuit diagram of the charging voltage-pumping circuit unit 11 according to an embodiment of the present invention. FIG. 8 is a circuit diagram of a transferring voltage-pumping circuit unit according to an embodiment of the present invention.

High voltage output from a second coil of a high voltage transformer, which has a first coil and the second coil in the ratio of 1 to 100, is pumped into a higher voltage by the voltage-pumping circuit unit 10 using a diode. The high voltage is applied to each of rollers included in an image forming apparatus.

The high voltage output from the voltage-pumping circuit unit 10 is output to the high voltage divide circuit unit 20 parallel to the rollers. The high voltage divide circuit unit 20 divides the high voltage into a lower voltage of approximately 3V and applies the lower voltage to the multiplexer 30.

Figure 9:
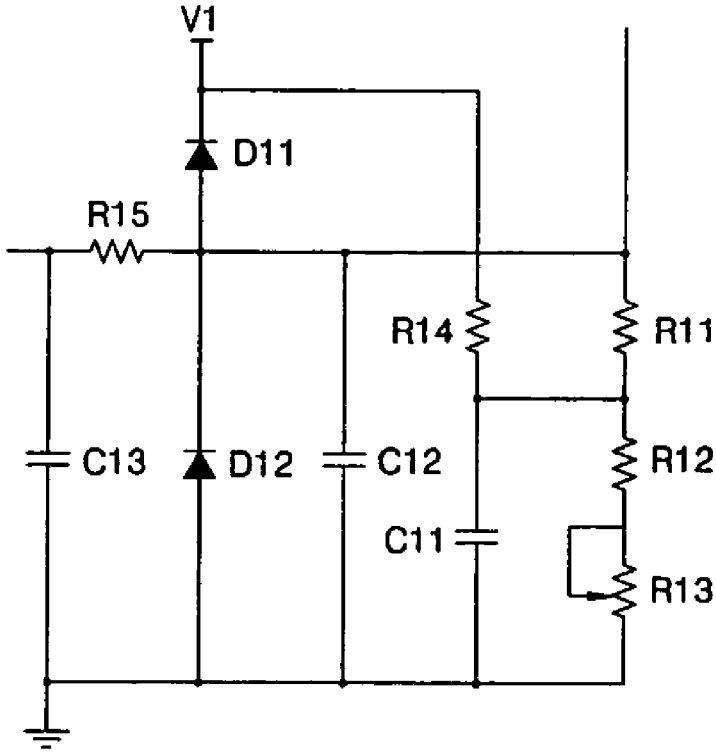
FIG. 9 is a circuit diagram of a high voltage divide circuit unit according to an embodiment of the present invention.

Each of the high voltage divide circuit units 21 through 27 included in the high voltage divide circuit unit 20 divides a high voltage output from each of the charging voltage pumping circuit unit 11, the developing voltage-pumping circuit unit 12, the transferring yellow voltage-pumping circuit unit 13, the transferring magenta voltage-pumping circuit unit 14, the transferring cyan voltage-pumping circuit unit 15, the transferring black voltage-pumping circuit unit 16, and the paper-absorbing roller voltage-pumping circuit unit 17. FIG. 9 is a circuit diagram of the high voltage divide circuit unit 20 according to an embodiment of the present invention.

The multiplexer 30 receives a plurality of divide signals output from the high voltage divide circuit units 21 through 27, and selects and outputs a divide signal corresponding to the resistance of a roller to be sensed in response to select signals S0, S1 and S2. All the high voltages output from rollers are divided and input to the multiplexer 30. Then, the multiplexer 30 selects an output signal in response to the select signals S0, S1 and S2 and outputs the signal to the roller resistance sensing circuit unit 40.

FIG. 6 illustrates an example of a select signal input to the multiplexer 30. Referring to FIG. 6, one of seven input signals may be selected and output using three select signals. The exemplary embodiment includes three select signals enabling up to eight inputs to be selected by the multiplexer. Those of ordinary skill in the art will appreciate, however, that the number of select signals is a matter of design choice, and more or fewer inputs can be selected by the multiplexer by reducing or increasing the number of select signals.

Figure 10:
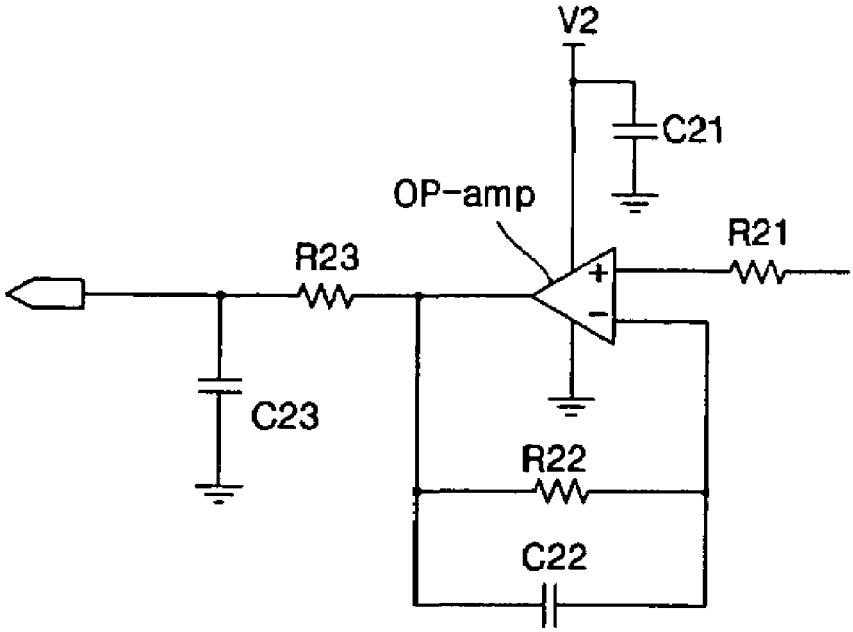
FIG. 10 is a circuit diagram of a roller resistance sensing circuit unit according to an embodiment of the present invention.

The roller resistance sensing circuit unit 40 resets a signal output from the multiplexer 30 to meet an input voltage range of the ADC 52 and outputs the reset signal. The roller resistance sensing circuit unit 40, which preferably comprises an operation amplifier (OP AMP), eliminates noise components from a signal and may function as an amplifying unit. FIG. 10 is a circuit diagram of the roller resistance sensing circuit unit 40 according to an embodiment of the present invention.

The ADC 52 receives the signal output from the roller resistance sensing circuit unit 40 and converts the signal into a digital signal. The image processing controller 50 calculates a resistance value of each roller using the digital signal output from the ADC 52 and output a pulse width modulation (PWM) signal based on the calculated resistance value. In other words, the image processing controller 50 appropriately increases or decreases a high voltage control signal according to a change in the resistance value of a roller caused by environmental changes or the lifespan of the roller.

A chopping circuit unit (not shown) chops the high voltage control PWM signal and transmits the chopped high voltage control PWM signal to a high voltage transformer (not shown). The high voltage transformer transforms the chopped high voltage control PWM signal output from the chopping circuit unit into a high voltage and transmits the high voltage to the voltage-pumping circuit unit 10.

Figure 11:
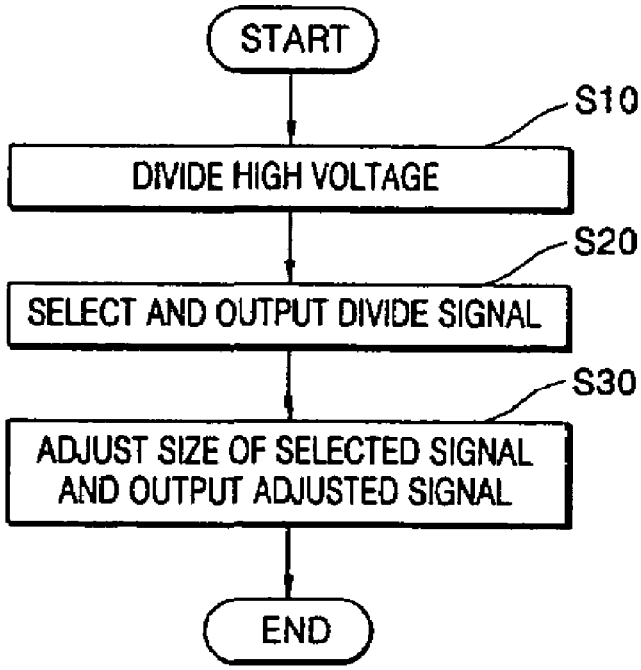
FIG. 11 is a flowchart illustrating a method of sensing roller resistance according to an embodiment of the present invention.

FIG. 11 is a flowchart illustrating a method of sensing roller resistance according to an embodiment of the present invention. Referring to FIG. 11, in the method of applying high voltages to the rollers included in the image forming apparatus and calculating the resistance values of the rollers in the high voltage generator 1, high voltages output from the voltage pumping circuit units 11-17, which respectively output the high voltages to the rollers, are divided by the high voltage divide circuit units 21 through 27, respectively (S10).

The divide signals output from the high voltage divide circuit units 21 through 27 are input to the multiplexer 30, and a divide signal corresponding to the resistance of a roller to be sensed is selected in response to the select signals S0, S1 and S2, and output (S20).

A signal output from the multiplexer 30 is reset by the roller resistance sensing circuit unit 40 to meet the input voltage range of the ADC 52 and then output (S30). The signal output from the roller resistance sensing circuit unit 40 is preferably converted into a digital signal. The image processing controller 50 preferably calculates a resistance value of each roller using the digital signal and outputs the high voltage control PWM signal based on the calculated resistance value.

The high voltage control PWM signal output from the image processing controller 50 is preferably chopped by the chopping circuit unit and transmitted to the high voltage transformer. The high voltage transformer preferably transforms the chopped signal output from the chopping circuit unit into a high voltage and transmits the high voltage to the voltage-pumping circuit unit 10.

As described above, when embodiments of the present invention are used, a roller resistance sensing circuit unit is commonly used in a high voltage generator of an image forming apparatus. As a result, a circuit can be simplified, manufacturing costs can be decreased, and the size of a printed circuit board of a high voltage generating board can be reduced.

In addition, since it is not required to implement additional roller resistance sensing circuit units to additionally sense roller resistance, more roller resistances can be sensed.

The roller resistance sensing circuit unit transmits one control signal to the image processing controller, thereby reducing the number of control signals.

While embodiments of the present invention have been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A high voltage generator for applying high voltages to a plurality of rollers included in an image forming apparatus and sensing resistance values of the rollers, the high voltage generator comprising:

a plurality of voltage-pumping circuit units for providing high voltages to the respective rollers;

a plurality of high voltage divide circuit units for dividing the high voltages output from the respective voltage-pumping circuit units;

a multiplexer for receiving a plurality of divide signals output from the high voltage divide circuit units, and for selecting and outputting a divide signal which corresponds to a resistance of a roller to be sensed, based on a predetermined select signal; and a roller resistance sensing circuit unit for resetting the selected divide signal received from the multiplexer to meet an input voltage range of an analog-to-digital converter and outputting the reset signal, said roller resistance sensing circuit unit being commonly used to sense the resistance values of the plurality of rollers.

2. The high voltage generator of claim 1, wherein the analog-to-digital converter receives the reset signal output from the roller resistance sensing circuit unit and converts the reset signal into a digital signal.

3. The high voltage generator of claim 2, further comprising an image processing controller for calculating the resistance value of each of the rollers using the digital signal output from the analog-to-digital converter and outputting a high voltage control pulse width modulation signal based on the calculated resistance value.

4. The high voltage generator of claim 3, further comprising a chopping circuit unit for chopping the high voltage control pulse width modulation signal output from the image processing controller and transmitting the chopped high voltage control pulse width modulation signal to a high voltage transformer.

5. The high voltage generator of claim 4, further comprising a high voltage transformer for transforming the chopped high voltage control pulse width modulation signal output from the chopping circuit unit into a high voltage and transmitting the high voltage to a corresponding voltage-pumping circuit unit.

6. The high voltage generator of claim 1, wherein the rollers comprise at least one of a charging roller, a developing roller, a transferring roller, and a paper-absorbing roller.

7. A method of applying high voltages to a plurality of rollers included in an image forming apparatus and sensing resistance values of the rollers using a high voltage generator, the method comprising:

dividing the high voltages respectively output from a plurality of voltage-pumping circuit units using a plurality of high voltage divide circuit units respectively corresponding to the voltage-pumping circuit units;

receiving a plurality of divide signals output from the high voltage divide circuit units at a multiplexer, and selecting and outputting one of said divide signals, which corresponds to a resistance of a roller to be sensed, based on a predetermined select signal; and resetting the selected divide signal output from the multiplexer to meet an input voltage range of an analog-to-digital converter and outputting the reset signal.

8. The method of claim 7, further comprising receiving the reset signal and converting the reset signal into a digital signal.

9. The method of claim 8, further comprising calculating the resistance value of each of the rollers using the digital signal and outputting a high voltage control pulse width modulation signal based on the calculated resistance value.

10. The method of claim 9, further comprising chopping the high voltage control pulse width modulation signal and transmitting the chopped high voltage control pulse width modulation signal to a high voltage transformer.

11. The method of claim 10, further comprising transforming the chopped high voltage control pulse width modulation signal into a high voltage and transmitting the high voltage to a corresponding voltage-pumping circuit unit.

12. The method of claim 7, wherein the rollers comprise at least one of a charging roller, a developing roller, a transferring roller, and a paper-absorbing roller.

* * * * *